US009625191B2

(12) United States Patent
Fujisawa et al.

(10) Patent No.: US 9,625,191 B2
(45) Date of Patent: Apr. 18, 2017

(54) CONDENSING APPARATUS

(75) Inventors: Ryo Fujisawa, Kobe (JP); Masatake Toshima, Kobe (JP); Yoshihiro Nakayama, Takasago (JP); Yoshitaka Baba, Takasago (JP); Satoshi Ide, Takasago (JP); Koichiro Iizuka, Takasago (JP); Kunihiko Suto, Tokyo (JP); Hiroshi Egawa, Tokyo (JP); Ichirou Sakuraba, Nagoya (JP); Daisuke Hayashi, Nagoya (JP); Keiji Sugano, Amagasaki (JP); Hans Madsboll, Taastrup (DK); Klaus Damgaard Kristensen, Hojbjerg (DK)

(73) Assignees: Tokyo Electric Power Company, Incorporated, Tokyo (JP); Chubu Electric Power Company, Incorporated, Aichi (JP); THE KANSAI ELECTRIC POWER CO., INC., Osaka (JP); Kobe Steel, Ltd., Hyogo (JP); DANISH TECHNOLOGICAL INSTITUTE, Taastrup (DK); JOHNSON CONTROLS DENMARK APS, Hojbjerg (DK)

( * ) Notice: Subject to any disclaimer, the term of this patent is extended or adjusted under 35 U.S.C. 154(b) by 570 days.

(21) Appl. No.: 14/112,889

(22) PCT Filed: Apr. 13, 2012

(86) PCT No.: PCT/JP2012/002604

§ 371 (c)(1),
(2), (4) Date: Oct. 18, 2013

(87) PCT Pub. No.: WO2012/144182

PCT Pub. Date: Oct. 26, 2012

(65) Prior Publication Data

US 2014/0041410 A1 Feb. 13, 2014

(30) Foreign Application Priority Data

Apr. 20, 2011 (JP) ..... 2011-094136

(51) Int. Cl.
*F28D 5/00* (2006.01)
*F25B 39/04* (2006.01)
(Continued)

(52) U.S. Cl.
CPC ..... *F25B 39/04* (2013.01); *F25B 9/002* (2013.01); *F25B 40/04* (2013.01); *F28B 1/02* (2013.01);
(Continued)

(58) Field of Classification Search
CPC ..... F25B 39/04; F25B 9/02; F25B 31/008; F25B 31/006; F28B 1/05; F28B 9/02; F28B 9/04; F28B 3/04
See application file for complete search history.

(56) References Cited

U.S. PATENT DOCUMENTS 1,946,328 A 2/1934 Neff
4,843,837 A 7/1989 Ogawa et al.
(Continued)

FOREIGN PATENT DOCUMENTS

CN 85108065 A 4/1986
CN 101523130 A 9/2009
(Continued)

OTHER PUBLICATIONS

The extended European search report issued by the European Patent Office on Sep. 10, 2014, which corresponds to European Patent Application No. 12773831.8-1602 and is related to U.S. Appl. No. 14/112,889.
(Continued)

*Primary Examiner* — Elizabeth Martin
(74) *Attorney, Agent, or Firm* — Studebaker & Brackett PC

(57) ABSTRACT

The condensing apparatus 71 includes: a compressor 10 which has a compression part 20 compressing a working fluid; a condenser 13 which condenses the working fluid
(Continued)

compressed by the compression part 20; and a spray mechanism 81 including a nozzle 82 which sprays a cooling fluid into a fluid passage 91 to cool the working fluid flowing through the fluid passage 91 between a discharge opening CS2 of the compression part 20 and an inlet 13*a* of the condenser 13.

8 Claims, 5 Drawing Sheets

(51) Int. Cl.

| | |
|---|---|
| ***F28B 1/02*** | (2006.01) |
| ***F28B 9/02*** | (2006.01) |
| ***F28B 9/04*** | (2006.01) |
| ***F28B 3/04*** | (2006.01) |
| ***F28B 5/00*** | (2006.01) |
| ***F25B 40/04*** | (2006.01) |
| ***F25B 9/00*** | (2006.01) |

(52) U.S. Cl.
CPC ..... *F28B 3/04* (2013.01); *F28B 5/00* (2013.01); *F28B 9/02* (2013.01); *F28B 9/04* (2013.01)

(56) References Cited

U.S. PATENT DOCUMENTS

| | | | | |
|---|---|---|---|---|
| 5,097,677 | A * | 3/1992 | Holtzapple | F25B 31/008 62/500 |
| 6,070,426 | A * | 6/2000 | Sakashita | F25B 39/04 62/114 |
| 6,189,871 | B1 * | 2/2001 | Schlageter | F01K 3/002 261/118 |
| 6,786,059 | B1 * | 9/2004 | Piao | F24F 3/1423 62/124 |
| 2001/0002541 | A1 | 6/2001 | Patel et al. | |
| 2002/0050144 | A1 | 5/2002 | Patel et al. | |
| 2003/0150233 | A1 | 8/2003 | Jensen et al. | |
| 2008/0078204 | A1 | 4/2008 | Ignatiev | |
| 2009/0229280 | A1 * | 9/2009 | Doty | F04D 29/284 62/115 |

FOREIGN PATENT DOCUMENTS

| | | | |
|---|---|---|---|
| EP | 0180151 | A2 | 5/1986 |
| JP | S55-64075 | U | 5/1980 |
| JP | 61-159053 | | 7/1986 |
| JP | 63-87557 | A | 4/1988 |
| JP | 63-286666 | A | 11/1988 |
| JP | 2003-534519 | A | 11/2003 |
| JP | 2010-53765 | A | 3/2010 |
| WO | 01/20962 | A1 | 3/2001 |

OTHER PUBLICATIONS

International Search Report and Written Opinion from the Japanese Intellectual Property Office in corresponding International Application No. PCT/JP2012/002604, mailed May 22, 2012, pp. 1-8.

* cited by examiner

CONDENSING APPARATUS

TECHNICAL FIELD

The present invention relates to a condensing apparatus used for such as refrigerator.

BACKGROUND ART

Conventionally, a refrigerator provided with a refrigerant circuit is known, and as a working fluid (refrigerant) for the refrigerator, for example, various fluids are used such as water and a hydrocarbon process gas.

In the refrigerator, the refrigerant evaporated by an evaporator is compressed by a compressor and turns to superheated vapor, and then, the superheated vapor is condensed by a condenser. In the condenser, the superheated vapor is cooled, for example, with cooling water and turns to saturated vapor, and then, the saturated vapor is further cooled and condensed. Hence, the condenser has two main heat-transfer regions: a superheat region where the superheated vapor turns to the saturated vapor and a condensation region where the saturated vapor is condensed. For example, Patent Document 1 cited below discloses a refrigerator having a condensing apparatus in which water is used as a working fluid.

In the above superheat region, a heat-transfer coefficient is smaller than a heat-transfer coefficient in the condensation region. Hence, in the condenser, the area of a heat-transfer surface necessary for the superheat region tends to be larger, thereby requiring that the condenser should be enlarged.

Many refrigerators operate at a degree of superheat of approximately 5 to 7° C. However, in the refrigerator disclosed by Patent Document 1, for example, water is used as a refrigerant to make the degree of superheat higher, requiring a larger heat-transfer surface area in a superheat region. Specifically, in the refrigerator where water is used as the refrigerant, the vapor discharged from a compressor is superheated vapor having a large degree of superheat of approximately 100° C. The heat-transfer coefficient in the superheat region is approximately tens of watts/$m^2$K, which is approximately one-thousandth the heat-transfer coefficient (approximately 10000 W/$m^2$K) in a condensation region. Therefore, in the case where water is used as the refrigerant, the quantity of heat transferred in the superheat region is only several percent of the quantity of heat transferred in the whole of a condenser. Despite this fact, the superheat region needs a heat-transfer surface area equivalent to that of the condensation region, and thereby, the condenser especially tends to be large.

CITATION LIST

Patent Document

Patent Document 1: Japanese Unexamined Patent Publication No. 2003-534519A

SUMMARY OF THE INVENTION

Therefore, it is an object of the present invention to provide a condensing apparatus in which a condenser can be miniaturized.

A condensing apparatus according to the present invention includes a compressor which has a compression part compressing a working fluid; a condenser which condenses the working fluid compressed by the compression part; and a spray mechanism having a nozzle which sprays a cooling fluid into a fluid passage to cool the working fluid flowing through the fluid passage between a discharge opening of the compression part and an inlet of the condenser.

EMBODIMENTS FOR CARRYING OUT THE INVENTION

Embodiments of the present invention will be below described in detail with reference to the drawings.

<First Embodiment>

Figure 1:
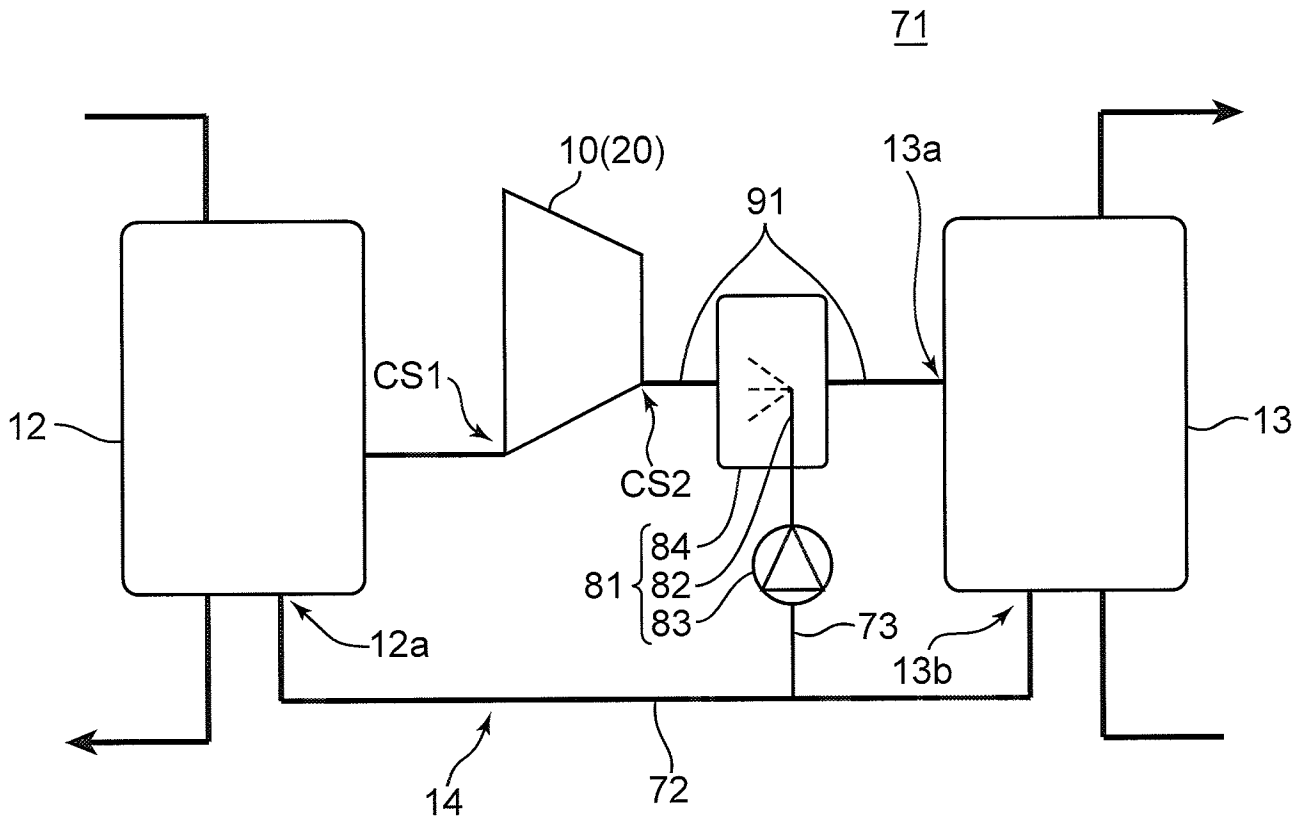
FIG. 1 is a schematic view showing a configuration of a condensing apparatus according to a first embodiment of the present invention.

As shown in FIG. 1, a condensing apparatus 71 according to this embodiment includes: a refrigerant circuit 14 provided with a compressor 10, an evaporator 12 and a condenser 13; and a spray mechanism 81. The condensing apparatus 71 can be used for such as a refrigerator.

The compressor 10 houses a compression part 20 including, for example, a rotor (not shown) and rotating the rotor to thereby compress water vapor as a working fluid (refrigerant) evaporated by the evaporator 12. The temperature and pressure of the water vapor are relatively low, and in this embodiment, the water vapor as the working fluid compressed by the compression part 20 has, for example, a temperature of 200° C. or below at atmospheric pressure or below at a discharge opening CS2 of the compression part 20.

Specifically, for example, at a suction opening CS1 of the compression part 20, the water vapor as the working fluid has a pressure of approximately 0.8 to 1.7 kPa and a temperature of approximately 5 to 15° C. At the discharge opening CS2 of the compression part 20, it has a pressure of approximately 1.5 to 8 kPa and a temperature of approximately 40 to 200° C.

The condenser 13 has a structure designed to keep the working fluid from coming into direct contact with a fluid (e.g., cooling water or the like) for condensing the working fluid, and hence, it is an indirect heat exchanger having divided spaces for permitting those fluids to flow separately.

The indirect heat exchanger makes a heat exchange indirectly between the working fluid and the fluid for condensing the working fluid, for example, via a heat-transfer tube, a partition wall or the like. The pressure range and the temperature range inside of the condenser 13 and the pressure range and the temperature range inside of a fluid passage 91 (described later) are substantially equal to the pressure range and the temperature range in the above discharge opening CS2 of the compression part 20.

Through the refrigerant circuit 14, the working fluid compressed by the compressor 10 is sent to the condenser and condensed there. In this way, the working fluid undergoes phase changes and circulates through the refrigerant circuit 14. The evaporator 12 evaporates the refrigerant and thereby supplies a secondary heating medium with cold heat, and the secondary heating medium is supplied to a user unit (not shown) cooling an object to be cooled such as room air.

The spray mechanism 81 sprays a cooling fluid into the fluid passage 91 between the discharge opening CS2 of the compression part 20 and an inlet 13*a* of the condenser 13 and thereby cools the working fluid flowing through the fluid passage 91. The spray mechanism 81 includes a nozzle 82, a pump 83 and a spray chamber 84.

The spray chamber 84 is arranged in the middle of the fluid passage 91 between the discharge opening CS2 of the compression part 20 and the inlet 13*a* of the condenser 13.

The nozzle 82 is arranged inside of the spray chamber 84 and the pump 83 is arranged in the middle of a branch pipe 73 which branches from piping 72 connecting an outlet 13*b* of the condenser 13 and an inlet 12*a* of the evaporator 12.

The nozzle 82 is connected to the front end of the branch pipe 73.

The working fluid condensed by the condenser 13 and discharged from the outlet 13*b* flows through the piping 72 toward the evaporator 12. At this time, if the pump 83 is in operation, then a part of the working fluid flowing through the piping 72 is sent to the nozzle 82 through the branch pipe 73 and is sprayed as the cooling fluid from the nozzle 82. Hence, in the first embodiment, the part of the working fluid sent to the nozzle 82 through the branch pipe 73 is used as the cooling fluid. The nozzle 82 is designed to spray the working fluid as the cooling fluid toward the upstream side of the fluid passage 91.

<Second Embodiment>

Figure 2:
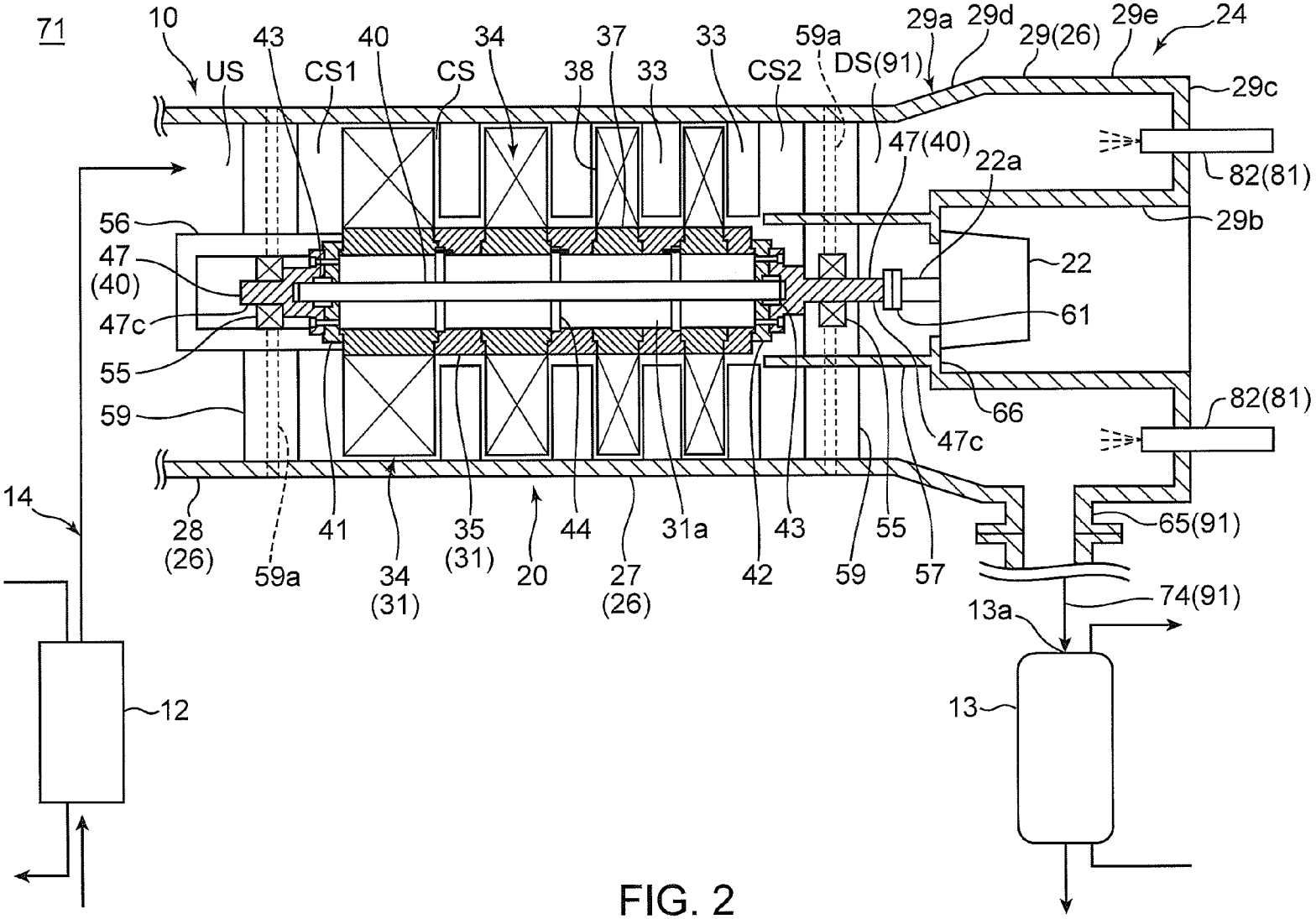
FIG. 2 is a schematic view showing a configuration of a condensing apparatus according to a second embodiment of the present invention, mainly showing a specific configuration of a compressor in the condensing apparatus.

FIG. 2 is a schematic view showing a configuration of a condensing apparatus 71 according to a second embodiment of the present invention, mainly showing a specific configuration of the compressor 10. The condensing apparatus according to the second embodiment differs from that according to the first embodiment in the respect that the nozzle 82 of the spray mechanism 81 is attached directly to the compressor 10. The compressor 10 is configured as an axial compressor. The condensing apparatus 71 can be used for such as a refrigerator.

As shown in FIG. 2, the compressor 10 includes the compression part 20 having a compression space CS for compressing a working fluid, an electric motor 22 driving the compression part 20, and a velocity reducing part 24 reducing the flow velocity of the working fluid discharged from the compression space CS. The compressor 10 includes a casing 26 formed by: a first case portion 27 arranged in the compression part 20 and having a cylindrical shape; a second case portion 28 arranged on the one end side (upstream side) of the compression part 20; and a third case portion 29 arranged in the velocity reducing part 24 on the other end side (downstream side) of the compression part 20.

The compression part 20 includes the first case portion 27 and a rotor 31 inside of the first case portion 27. The space between the first case portion 27 and the rotor 31 functions as the compression space CS for compressing the working fluid. The compression space CS includes the suction opening CS1 on the left and the discharge opening CS2 on the right of FIG. 2. Through the suction opening CS1 on the left, the working fluid evaporated by the evaporator 12 is sucked into the compression space CS, compressed there as it goes to the right and discharged from the discharge opening CS2.

On the inner circumferential surface of the first case portion 27, a plurality of stationary vanes 33 are fixed apart from each other in the axial direction. The first case portion 27 is set in such a way that the axial direction is horizontal.

The rotor 31 includes a plurality of rotor vanes 34 apart from each other in the axial direction and alternate with the stationary vanes 33, and a plurality of spacers 35. Each spacer 35 is a cylindrical member and arranged inside in the radial direction of the corresponding stationary vane 33 and between the corresponding adjacent rotor vanes 34.

FIG. 2 shows the four rotor vanes 34 and the four spacers 35, but the present invention is not limited to this configuration.

The rotor vane 34 includes a cylindrical boss portion 37 and a vane portion 38 around and united with the boss portion 37. A plurality of the vane portions 38 are provided in the peripheral direction of the boss portion 37. The boss portion 37 has an outer circumferential surface flush with an outer circumferential surface of the spacer 35, and has an inner circumferential surface flush with an inner circumferential surface of the spacer 35.

The compression part 20 includes a driving shaft 40, a first pressing member 41, a second pressing member 42, a nut 43, and a disk member 44.

The driving shaft 40 is on the axial center of the first case portion 27 and extends in the axial direction of the first case portion 27. Both end portions 47 and 47 of the driving shaft 40 are outside of the rotor vanes 34 and the spacers 35 in the axial direction.

The first pressing member 41 is arranged in contact with the most upstream rotor vane 34 while the second pressing member 42 is arranged in contact with the spacer 35 outside of the most downstream rotor vane 34. The first and second pressing members 41 and 42 are arranged opposite in the axial direction, even though having the same configuration.

The first pressing member 41 has a disk shape and the pressing members 41 and 42 are each formed with a central through hole for inserting the driving shaft 40. The first pressing member 41 is fitted to the rotor vane 34, and thereby, the axial center of the first pressing member 41 coincides with the axial center of the most upstream rotor vane 34.

The second pressing member 42 is fitted to the spacer 35 outside of the most downstream rotor vane 34, and thereby, the axial center of the second pressing member 42 coincides with the axial center of the most downstream spacer 35. The rotor vanes 34 are each fitted to the spacers 35 adjacent thereto.

The spacer 35 and the boss portion 37 have an inner diameter far larger than the outer diameter of the driving shaft 40. Between the cylindrical part formed by the connected spacer 35 and boss portion 37 and the driving shaft 40, therefore, a space extending in the axial direction is formed, and the disk member 44 is provided in this space or an inner space 31*a* of the rotor 31.

The disk member 44 is perpendicularly postured to the driving shaft 40 and formed at the center with a through hole penetrating in the thickness direction. The driving shaft 40 is inserted in the through hole and thereby supported with each disk member 44 at a plurality of places in the middle thereof.

As shown in FIG. 2, the both end portions 47 and 47 of the driving shaft 40 are each supported with bearings 55 and 55 corresponding thereto in such a way that the both end portions 47 and 47 are rotatable.

Both bearings 55 and 55 are placed in an upstream housing 56 at one end and a downstream housing 57 at the other end, respectively. The upstream housing 56 and the second case portion 28 form a cylindrical space between and this space becomes an upstream space US for flowing the working fluid led into the compression space CS. On the other hand, the downstream housing 57 and the third case portion 29 form a cylindrical space between and this space becomes a downstream space DS for flowing the working fluid led from the compression space CS.

The housings 56 and 57 are supported to the second case portion 28 and the third case portion 29 respectively via a plurality of support members 59, 59 each having a rod shape and arranged radially in the circumferential directions. Each support member 59, 59 has a streamline shape in section and thereby does not block a flow of the working fluid even in the upstream space US and the downstream space DS. The figure shows an example where the support member 59 comes into the housing 57 in the downstream space DS, but this part coming into the housing 57 not necessarily has a rod shape.

The support member 59 is formed with supply-and-discharge passages 59*a* for supplying and discharging a lubricant. The lubricant is introduced from outside of the second case portion 28 and the third case portion 29, fed through one supply-and-discharge passage 59*a* to the bearing 55 and discharged through the other supply-and-discharge passage 59*a* from the bearing 55.

The end portion 47 of the driving shaft 40 on the discharge opening CS2 side is inside of the downstream housing 57 and connected to a rotating shaft 22*a* of the electric motor 22 via a flexible coupling 61 as an example of a vibration damping part. The driving shaft 40 of the compression part 20 is connected without any speed-up gear to the rotating shaft 22*a* of the electric motor 22 and thereby the rotor 31 has the same rotational speed as that of the electric motor 22.

The above described velocity reducing part 24 has the downstream space DS formed by the third case portion 29. The third case portion 29 has an outer circumferential surface portion 29*a* connected to an end of the first case portion 27 in the axial direction, an inner circumferential surface portion 29*b* inward from the outer circumferential surface portion 29*a* and extending in the axial direction, an end surface portion 29*c* connecting ends of the outer circumferential surface portion 29*a* and the inner circumferential surface portion 29*b* in the axial directions.

The outer circumferential surface portion 29*a* is formed midway in the axial direction with a flare portion 29*d* which is cylindrical and whose inner diameter gradually enlarges as it goes away from the discharge opening CS2. It is also formed with a portion 29*e* having a fixed inner diameter ahead of the flare portion 29*d*. On the other hand, the inner circumferential surface portion 29*b* is connected to an end of the downstream housing 57 and shaped like a cylinder having a fixed outer diameter in the axial direction. Hence, the downstream space DS has: a taper part which has a ring shape in a perpendicular section to the axial direction and whose sectional area enlarges gradually; and a parallel part which has a ring shape in a perpendicular section to the axial direction and whose sectional area is unchanged.

At least the taper part functions as a diffuser which reduces the flow velocity of the working fluid compressed in the compression part 20 and thereby recovers the pressure thereof, while the parallel part functions as a collector collecting the fluid whose flow velocity has been reduced in the taper part. In the velocity reducing part 24, the working fluid is sufficiently decelerated at the taper part and thereby recovers the pressure without an excessive loss at the parallel part. In the figure, the inner circumferential surface portion 29*b* is connected stepwise to the housing 57, but it may be connected without any step. Further, the inner circumferential surface portion 29*b* may be tapered at a part thereof corresponding to the taper part of the outer circumferential surface portion 29*a*. Still further, the length or the like of the parallel part can be suitably selected in accordance with how much the flow velocity of the working fluid discharged from the discharge opening CS2 should be reduced.

The outer circumferential surface portion 29*a* is formed at the portion 29*e* forming the parallel part with, an outlet port 65 connected to piping 74 for leading, to the condenser 13, the working fluid whose flow velocity is reduced inside of the downstream space DS.

The inner circumferential surface portion 29*b* is formed with a motor support portion 66 extending inward in the radial direction from the connection part thereof to the housing 57. The electric motor 22 is placed inward from the inner circumferential surface portion 29*b* of the velocity reducing part 24 and attached to the motor support portion 66.

Figure 3:
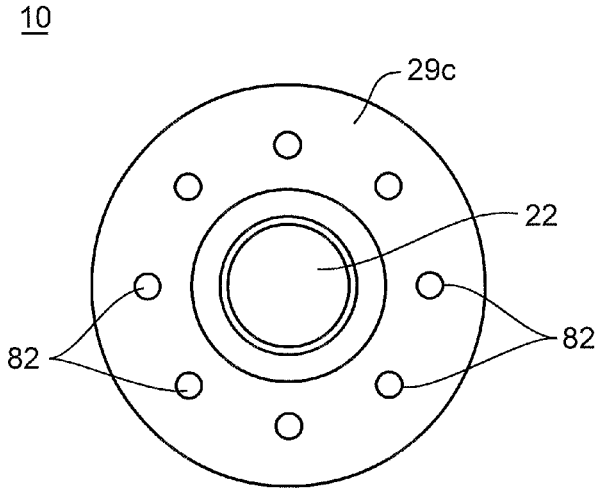
FIG. 3 is an end view of the compressor of FIG. 2, seen from the downstream side in the axial direction thereof.

FIG. 3 is an end view of the compressor 10 of FIG. 2, seen from the downstream side (the right side) in the axial direction thereof. As shown in FIGS. 2 and 3, in the second embodiment, the spray mechanism 81 includes a plurality of the nozzles 82 and does not include a spray chamber separate from the compressor 10, which is different from the first embodiment. As is not shown in FIG. 2, the spray mechanism 81 is configured, in the same way as the first embodiment shown in FIG. 1, in such a way that the pump 83 is arranged in the middle of the branch pipe 73 and the plurality of nozzles 82 are connected to the front end of the branch pipe 73.

In the second embodiment, the fluid passage 91 between the discharge opening CS2 of the compression part 20 and the inlet 13*a* of the condenser 13 includes the downstream space DS, the inner space of the outlet port 65 and the inner space of the piping 74. The nozzles 82 are arranged in the downstream space DS of the fluid passage 91.

The plurality of nozzles 82 are arranged in the end surface portion 29*c* of the third case portion 29. The nozzles are placed at substantially regular intervals over substantially the full circumference of the ring-shaped space of the downstream space DS, thereby uniformly cooling the working fluid which is discharged from the discharge opening CS2 of the compression part 20 and flows through the ring-shaped space.

Each nozzle 82 is inserted into the downstream space DS from a through hole (not shown) formed in the end surface portion 29*c* in such away that a spray hole (not shown) formed at the tip of each nozzle 82 is inside of the downstream space DS. Each spray hole is oriented upward in the axial direction, thereby enabling each nozzle 82 to spray the working fluid with substantially facing toward the upstream side of the fluid passage 91.

As shown in FIG. 2, in the condensing apparatus 71, the outlet port 65 is formed in the side part of the velocity reducing part 24 and extends substantially perpendicularly (downward in FIG. 2) to the axial direction. The working fluid discharged from the discharge opening CS2 of the compression part 20 flows in the axial direction inside of the velocity reducing part 24, and thereafter, goes toward the outlet port 65.

Here, the plurality of nozzles 82 are placed at the downstream end part (the end surface portion 29*c*) of the compressor 10 in the axial direction. In other words, the nozzles 82 are located downstream from the outlet port 65 in the velocity reducing part 24. This makes it possible to prevent each nozzle 82 from obstructing a flow of the working fluid and thereby suppress a pressure loss thereof caused by the plurality of nozzles 82 provided there.

The nozzle 82 sprays the working fluid in the form of particles having certain sizes, and preferably, the particle sizes may be smaller to make a heat exchange more efficiently between the working fluids. In order to make the particle sizes smaller, the diameter of the spray hole (not shown) at the tip of the nozzle 82 needs to be narrowed, thereby naturally reducing the quantity of the working fluid sprayed by the nozzle 82. Accordingly, in the second embodiment, the plurality of nozzles 82 are provided to thereby make the particle sizes of the sprayed working fluid smaller and simultaneously maintain the total quantity of the working fluid.

In the condensing apparatus 71 according to this embodiment, as the rotating shaft 22*a* of the electric motor 22 rotates in the compressor 10, the driving shaft 40 of the compression part 20 also rotates at the same rotational speed to rotate the rotor 31 around the axis thereof. Thereby, the working fluid inside of the upstream space US is sucked through the suction opening CS1 into the compression space CS, compressed and sent rightward in FIG. 2 in the compression space CS, discharged through the discharge opening CS2 to the downstream space DS. The working fluid is decelerated and recovers the pressure in the velocity reducing part 24 and discharged through the outlet port 65. The pump of the spray mechanism 81 comes into operation, thereby allowing the nozzle 82 to spray the working fluid as the cooling fluid into the space of the velocity reducing part 24 to cool the working fluid compressed by the compression part 20 in the space of the velocity reducing part 24.

As described so far, in the first and second embodiments, the nozzle 82 sprays the working fluid as the cooling fluid into the fluid passage 91 to thereby cool the working fluid flowing through the fluid passage 91. Therefore, the degree of superheat of the working fluid can be lowered in advance before the working fluid flows into the condenser 13, thereby reducing the area of a heat-transfer surface necessary for cooling superheated vapor in the condenser 13 and hence miniaturizing the condenser. In addition, as described above, the heat-transfer surface area can be reduced, thereby cutting down costs for the condenser 13.

Furthermore, in the first and second embodiments, the cooling fluid is sprayed toward the upstream side of the fluid passage 91, thereby heightening the relative velocity of the cooling fluid to the working fluid, as compared with the case where the cooling fluid is sprayed toward the downstream side of the fluid passage 91 or sprayed perpendicularly to the fluid passage 91. Therefore, the working fluid can exchange heat more efficiently with the cooling fluid to thereby more efficiently cool the working fluid flowing through the fluid passage 91.

In the second embodiment, the flow velocity of the working fluid whose pressure and flow velocity have been raised in the compression part 20 can be reduced in the velocity reducing part 24 functioning as a diffuser. In addition, in the second embodiment, the nozzle 82 is attached to the compressor 10 in such a way that the cooling fluid can be sprayed into the space of the velocity reducing part 24, and hence, there is no need to separately provide a member such as a spray chamber for spraying the cooling fluid from the nozzle 82.

Moreover, in the second embodiment, the space of the velocity reducing part 24 extends in the axial direction of the rotating shaft of the electric motor 22 and surrounds the electric motor 22, and the space has a ring shape in a perpendicular section to the axial direction. Further, the plurality of nozzles 82 are provided along the circumferential direction of the ring-shaped space. Therefore, the cooling fluid can be sprayed on a plurality of places inside of the space of the velocity reducing part 24.

In the first and second embodiments, a part of the working fluid discharged from the outlet 13*b* the condenser 13 is used as the cooling fluid and the pump 83 sends the part of the working fluid to the nozzle 82. According to this configuration, there is no need to prepare a cooling fluid separate from the working fluid.

In the second embodiment, the driving shaft of the compression part is connected without any speed-up gear to the rotating shaft of the electric motor. For example, in order to provide a speed-up gear for a conventional condensing apparatus used for a refrigerator, an electric motor needs to be offset (shifted in the radial direction thereof) with respect to a compression part. This offset is unnecessary for the condensing apparatus according to the second embodiment, and thereby, the width of the compressor in the diametrical direction can be prevented from enlarging. Further, no speed-up gear is provided, thereby preventing an increase in the width of the compressor in the diametrical direction.

The present invention is not limited to the above embodiments, and hence, various changes, modifications and the like can be expected without departing from the scope of the present invention. For example, the embodiments show the compressor 10 used for a condensing apparatus, but the present invention is not limited to this example. For example, the compressor 10 may be configured as a compressor used for, for example, a chiller for obtaining cooling water, an air conditioner, a concentrator or the like.

The working fluid is not limited to water vapor, and for example, a variety of fluids such as a hydrocarbon process gas can be used. Further, the compressor is not limited to an axial compressor.

Furthermore, in the above embodiments, as an example, the nozzle sprays the working fluid toward the upstream side of the fluid passage, but the present invention is not limited to this example. For example, the nozzle may spray the working fluid toward the downstream side of the fluid passage or sprayed perpendicularly to the fluid passage.

Figure 4:
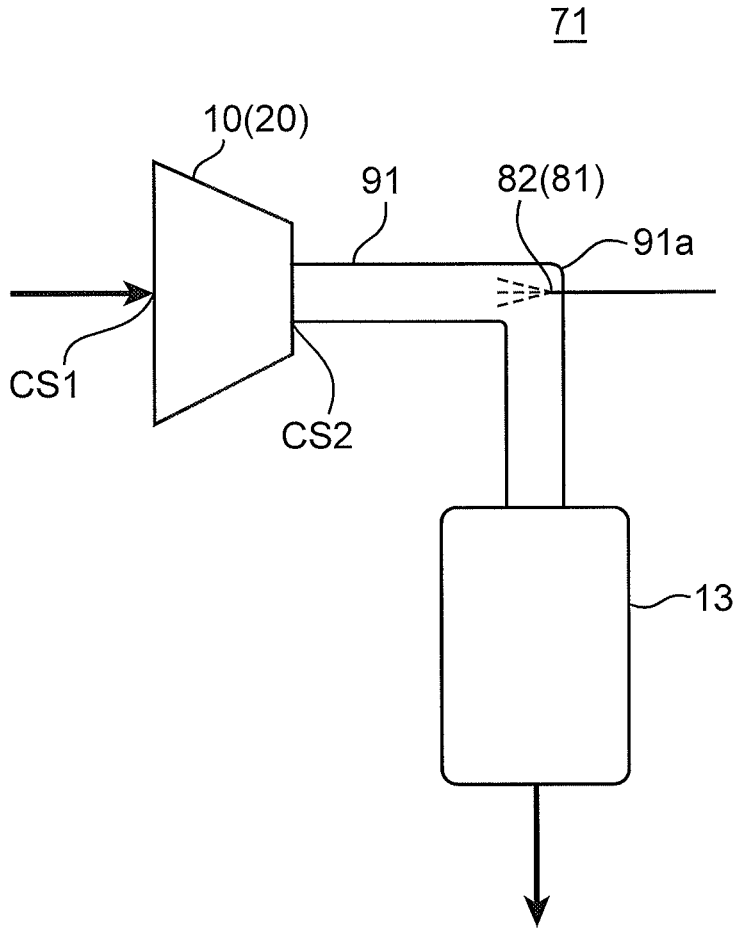
FIG. 4 is a schematic view showing a variation 1 of the condensing apparatus.

Moreover, for example, the present invention may be a condensing apparatus 71 according to a variation 1 shown in FIG. 4. In the variation 1, the fluid passage 91 is formed by piping connecting the compressor 10 and the condenser 13. The piping has a bent part 91*a* for bending the direction in which the working fluid flows, and the nozzle 82 is arranged in the bent part 91*a*. When the working fluid flows through the bent part 91*a*, a pressure loss thereof is naturally caused more easily in the bent part 91*a* than in a straight part of the piping. Hence, the pressure loss is less affected, even though the nozzle is arranged in the bent part 91*a*.

Let's suppose that the nozzle is arranged in a straight part of the piping and sprays the cooling fluid toward the upstream side of the fluid passage. In this case, for example, the nozzle needs to be inserted into the piping from the side surface of the piping and be bent near the tip thereof in such a way that the spray hole of the nozzle faces toward the upstream side. This configuration can relatively enlarge the percentage of the nozzle occupied in the sectional area of the fluid passage, thereby making the pressure loss greater.

In contrast, as shown in FIG. 4, if the nozzle 82 is arranged in the bent part 91*a*, then with the pressure loss being less affected by the arrangement thereof, the nozzle 82 is capable of spraying the cooling fluid toward the upstream side of the fluid passage.

Figure 5A:
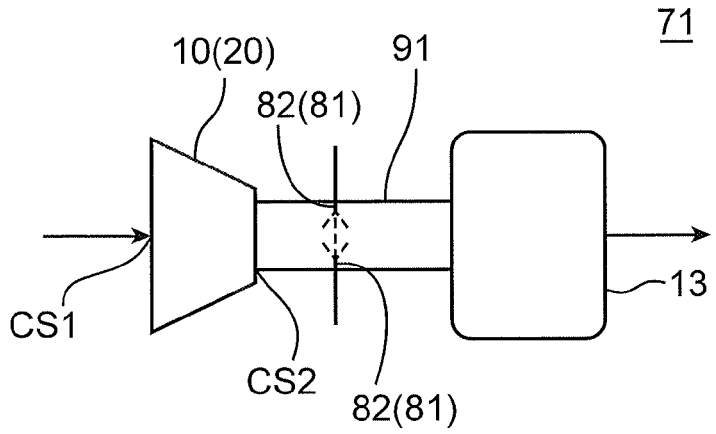
FIG. 5A is a schematic view showing a variation 2 of the condensing apparatus and FIG. 5B is an enlarged sectional view showing a part of piping connecting a compressor and a condenser in a variation 3 of the condensing apparatus.

As the case where the nozzle is arranged in a straight part of the piping, for example, FIG. 5A shows a variation 2 where a plurality of the nozzles 82 are provided in a straight part of the fluid passage 91 (piping) connecting the compressor 10 and the condenser 13. In the variation 2, the two nozzles 82 face each other vertically in the straight part of the piping extending substantially horizontally. Specifically, the upper nozzle 82 has a spray hole (not shown) for spraying the cooling fluid downward inside of the piping (in a direction substantially perpendicular to a flow direction of the working fluid compressed by the compression part), while the lower nozzle 82 has a spray hole (not shown) for spraying the cooling fluid upward inside of the piping.

Figure 5B:
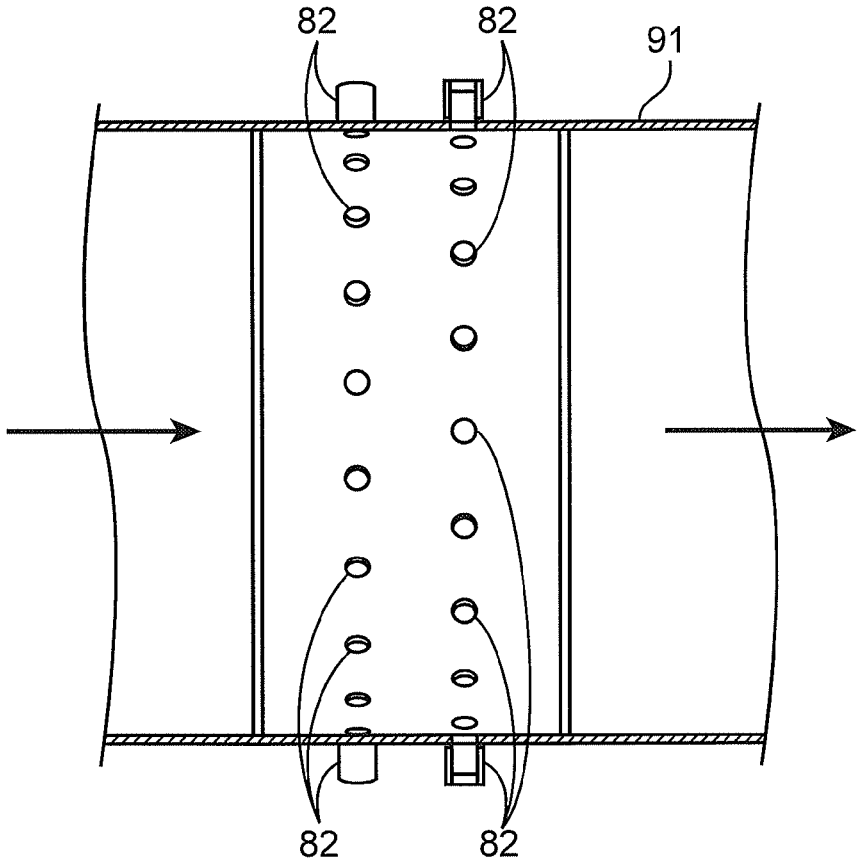

In addition, as seen in a variation 3 shown in FIG. 5B, in a straight part of the fluid passage (piping) 91, a plurality of (a large number of) the nozzles 82 may be provided in the shape of a ring along the circumferential direction of the piping. These nozzles 82 are arranged in the straight part and spray the cooling fluid in a direction substantially perpendicular to a flow direction of the working fluid compressed by the compression part. These nozzles 82 are placed at substantially regular intervals in the circumferential direction. In the variation 3, two rows of the ring-shaped nozzles 82 are provided, and the two ring-shaped rows are separate from each other in the flow direction of the working fluid indicated by the arrows of FIG. 5B. In the variation 3, each nozzle 82 can spray the cooling fluid inward in the radial direction of the piping, thereby uniformly cooling the working fluid flowing through the piping.

Furthermore, in the variation 3, each nozzle 82 is attached to the fluid passage (piping) 91 in such a way that the tip thereof hardly protrudes inward from the inner surface of the piping. Therefore, each nozzle 82 is prevented from obstructing a flow of the working fluid inside of the fluid passage 91, and thereby, the pressure loss thereof is far less affected by the arrangement of the nozzles 82.

In the variations 2 and 3, the plurality of nozzles 82 are provided in the straight part of the fluid passage 91, but a single nozzle 82 may be provided in the straight part. Moreover, the variations 2 and 3 show the examples where in the straight part of the fluid passage 91, the nozzles 82 spray the cooling fluid inward in the radial direction thereof. However, the present invention is not limited to this, and for example, in the straight part of the fluid passage 91, the nozzles 82 may spray the cooling fluid toward the upstream side thereof. In this case, for example, the nozzles 82 are inserted into the piping as the straight part of the fluid passage 91 and bent upstream near the tips of the nozzles 82 to thereby enable the nozzles 82 to spray the cooling fluid toward the upstream side.

Furthermore, for example, the nozzle may be directed diagonally to a flow direction of the working fluid in the straight part whereby the cooling fluid can be sprayed toward the upstream side. In this case, the nozzle is attached to the straight part of the piping in such a way that the tip thereof hardly protrudes inward from the inner surface of the piping. Therefore, the nozzle is prevented from obstructing a flow of the working fluid inside of the piping, and thereby, the pressure loss thereof is far less affected by the arrangement of the nozzle.

The above embodiment mainly includes inventions with the following configurations.

A condensing apparatus according to the present invention includes a compressor which has a compression part compressing a working fluid; a condenser which condenses the working fluid compressed by the compression part; and a spray mechanism having a nozzle which sprays a cooling fluid into a fluid passage to cool the working fluid flowing through the fluid passage between a discharge opening of the compression part and an inlet of the condenser.

In this aspect, the nozzle sprays the cooling fluid into the fluid passage to thereby cool the working fluid flowing through the fluid passage. Therefore, before the working fluid compressed by the compression part flows into the condenser, the degree of superheat of the working fluid can be lowered in advance. This makes it possible to reduce the area of a heat-transfer surface necessary for cooling superheated vapor in the condenser and thereby miniaturize the condenser. In addition, as described above, the heat-transfer surface area can be reduced, thereby cutting down costs for the condenser.

In the above condensing apparatus, it is preferable that the nozzle is arranged so as to spray the cooling fluid toward an upstream side of the fluid passage.

In this aspect, the cooling fluid is sprayed toward the upstream side of the fluid passage, thereby heightening the relative velocity of the cooling fluid to the working fluid, as compared with the case where the cooling fluid is sprayed toward the downstream side of the fluid passage or sprayed perpendicularly to the fluid passage. Therefore, the working fluid can exchange heat more efficiently with the cooling fluid to thereby more efficiently cool the working fluid flowing through the fluid passage and lower the degree of superheat thereof.

In the above condensing apparatus, the fluid passage may have a bent part adapted to bend a flow direction of the working fluid and the nozzle may be arranged in the bent part. When the working fluid flows through the bent part, a pressure loss thereof is naturally caused more easily in the bent part than in a straight part (e.g., straight piping) of the fluid passage. Hence, the pressure loss is less affected, even though the nozzle is arranged in the bent part.

In the above condensing apparatus, it is preferable that the condenser is an indirect heat exchanger which makes a heat exchange between the working fluid and a fluid for condensing the working fluid with both fluids being out of direct contact with each other.

For example, in a direct heat exchanger as a condenser where a working fluid is mixed with a fluid (e.g., cooling water) for condensing the working fluid, the cooling water comes into direct contact with the working fluid. Therefore, the area of a heat-transfer surface is relatively large, and hence, the above problem of the heat-transfer surface area in the superheat region tends to be relatively small.

On the other hand, in the indirect heat exchanger according to this aspect, the problem of the heat-transfer surface area in the superheat region becomes more serious than in the direct heat exchanger. Accordingly, the present invention is especially effective which is capable of spraying the cooling fluid into the fluid passage from the nozzle and thereby lowering the degree of superheat of the working fluid in advance before the working fluid flows into the condenser.

In the above condensing apparatus, it is preferable that: the compressor further includes a velocity reducing part having a space for reducing a flow velocity of the working fluid discharged from the discharge opening of the compression part; the space of the velocity reducing part forms a part of the fluid passage; and the nozzle sprays the cooling fluid on the working fluid flowing through the velocity reducing part.

In this aspect, the flow velocity of the working fluid whose pressure and flow velocity have been raised in the compression part can be reduced in the velocity reducing part functioning as a diffuser. In addition, the cooling fluid is sprayed into the space of the velocity reducing part, and hence, there is no need to separately provide a member such as a spray chamber for spraying the cooling fluid from the nozzle.

In the above condensing apparatus, it is preferable that: the compressor further includes an electric motor having a rotating shaft; the compression part has a driving shaft connected to the rotating shaft of the electric motor; the rotating shaft of the electric motor is connected to an end of the driving shaft on a side of the discharge opening; the space of the velocity reducing part is formed so as to extend in an axial direction of the rotating shaft of the electric motor and surround the electric motor, and has a ring shape in a perpendicular section to the axial direction; and a plurality of the nozzles are provided along a circumferential direction of the space having the ring shape.

In this aspect, a plurality of the nozzles are provided along the circumferential direction of the space having the ring shape. Therefore, the cooling fluid can be sprayed on a plurality of places inside of the space of the velocity reducing part to thereby further efficiently cool the working fluid flowing through the fluid passage and lower the degree of superheat thereof.

In the above condensing apparatus, it is preferable that: the compressor further includes an outlet port connected to the space of the velocity reducing part for discharging the working fluid whose flow velocity is reduced in the velocity reducing part; and the nozzle is arranged in the velocity reducing part and located downstream from the outlet port in the velocity reducing part.

In this aspect, the nozzle is located downstream from the outlet port in the velocity reducing part. This makes it possible to prevent the nozzle from obstructing a flow of the working fluid during a process of reducing the flow velocity in the velocity reducing part and thereby suppress a pressure loss thereof caused by the nozzle provided there.

In the above condensing apparatus, the fluid passage may have a straight part; and the nozzle may be arranged in the straight part and spray the cooling fluid in a direction substantially perpendicular to a flow direction of the working fluid.

In the above condensing apparatus, it is preferable that: the spray mechanism further includes a pump; the cooling fluid is a part of the working fluid which is condensed and discharged from an outlet of the condenser; and the pump sends the part of the working fluid to the nozzle.

In this aspect, a part of the working fluid discharged from the outlet of the condenser is used as the cooling fluid and the pump sends the part of the working fluid to the nozzle.

According to this configuration, there is no need to prepare a cooling fluid separate from the working fluid.

In the above condensing apparatus, the present invention is especially suitable for the case where: the working fluid is water; and the pressure inside of the fluid passage through which the working fluid compressed by the compression part flows is within a range of 1.5 to 8 kPa.

In this aspect, the working fluid is water and the pressure inside of the fluid passage is extremely low. In this case, a heat exchange is apt to be made at a low efficiency in the condenser, thereby enlarging the area of a heat-transfer surface necessary for cooling superheated vapor to form saturated vapor in the condenser. Accordingly, in this aspect, the present invention is especially effective which is capable of spraying the cooling fluid into the fluid passage from the nozzle and thereby lowering the degree of superheat of the working fluid in advance before the working fluid flows into the condenser.

DESCRIPTION OF THE SYMBOLS

10: compressor
12: evaporator
13: condenser
14: refrigerant circuit
20: compression part
22: electric motor
22*a*: rotating shaft
24: velocity reducing part
31: rotor
40: driving shaft
71: condensing apparatus
81: spray mechanism
82: nozzle
83: pump
84: spray chamber
91: fluid passage
91*a*: bent part
CS1: compression-part suction opening
CS2: compression-part discharge opening

The invention claimed is:

1. A condensing apparatus, comprising:

a compressor which includes a compression part compressing a working fluid;

a condenser which condenses the working fluid compressed by the compression part; and a spray mechanism including a nozzle which sprays a cooling fluid into a fluid passage to cool the working fluid flowing through the fluid passage between a discharge opening of the compression part and an inlet of the condenser, wherein:

the compressor further includes an electric motor having a rotating shaft, and a velocity reducing part for reducing a flow velocity of the working fluid discharged from the discharge opening of the compression part, said velocity reducing part includes a case portion which has an outer circumferential surface portion and an inner circumferential surface portion, extending in an axial direction of the rotating shaft of the electric motor, and an end surface portion connecting downstream ends of the outer and the inner circumferential surface portions such that a space is formed in the case portion, said electrical motor in its entirety is disposed in a space formed radially inward from the inner circumferential surface portion;

the space of the velocity reducing part forms a part of the fluid passage; the space is formed so as to extend in the axial direction of the rotating shaft and has a ring shape in a perpendicular section to the axial direction; and a plurality of the nozzles are arranged along a circumferential direction on the end surface portion having the ring shape and spray the cooling fluid on the working fluid flowing through the velocity reducing part.

2. The condensing apparatus according to claim 1, wherein the nozzle is arranged so as to spray the cooling fluid toward an upstream side of the fluid passage.

3. The condensing apparatus according to claim 1, wherein:

the fluid passage has a bent part adapted to bend a flow direction of the working fluid; and the nozzle is arranged in the bent part.

4. The condensing apparatus according to claim 1, wherein the condenser is an indirect heat exchanger which makes a heat exchange between the working fluid and a fluid for condensing the working fluid with both fluids being out of direct contact with each other.

5. The condensing apparatus according to claim 1, wherein:

the compressor further includes an outlet port connected to the space of the velocity reducing part for discharging the working fluid whose flow velocity is reduced in the velocity reducing part; and the nozzle is arranged in the velocity reducing part and located downstream from the outlet port in the velocity reducing part.

6. The condensing apparatus according to claim 1, wherein:

the fluid passage has a straight part, the nozzle is arranged in the straight part and sprays the cooling fluid in a direction substantially perpendicular to a flow direction of the working fluid.

7. The condensing apparatus according to claim 1, wherein:

the spray mechanism further includes a pump;

the cooling fluid is a part of the working fluid which is condensed and discharged from an outlet of the condenser; and the pump sends the part of the working fluid to the nozzle.

8. The condensing apparatus according to claim 1, wherein:

the working fluid is water; and a pressure inside of the fluid passage through which the working fluid compressed by the compression part flows is within a range of 1.5 to 8 kPa.

* * * * *